United States Patent [19]

Windish

[11] 4,391,636

[45] Jul. 5, 1983

[54] METHOD OF AND APPARATUS FOR THE PRODUCTION OF NODULAR (DUCTILE) CAST IRON

[75] Inventor: Michael W. Windish, Bridgeton, Mo.

[73] Assignee: Wintec Company, St. Louis, Mo.

[21] Appl. No.: 331,163

[22] Filed: Dec. 16, 1981

[51] Int. Cl.[3] ..... C22C 37/00; C21C 7/00

[52] U.S. Cl. ..... 75/130 R; 75/53; 75/130 B; 266/114; 266/120; 266/216; 266/275

[58] Field of Search ..... 75/130 R, 153, 130 B; 266/114, 275, 120, 216

[56] References Cited

U.S. PATENT DOCUMENTS

| | | | |
|---|---|---|---|
| 3,650,516 | 3/1972 | Mantell | 266/216 |
| 3,802,680 | 4/1974 | Anders | 75/130 B |
| 3,833,361 | 9/1974 | Kusaka | 75/130 R |
| 3,870,512 | 3/1975 | Lee | 75/130 R |
| 4,134,757 | 1/1979 | Roberts | 75/53 |
| 4,210,195 | 7/1980 | McPherson | 75/130 B |
| 4,312,668 | 1/1982 | Mannion | 75/130 R |

*Primary Examiner*—P. D. Rosenberg

*Attorney, Agent, or Firm*—Polster, Polster & Lucchesi

[57] ABSTRACT

A process or method of and apparatus for the in-ladle treatment of molten base metal iron with a nodularizing agent (e.g., a magnesium bearing alloy) so as to produce substantially uniform spheriodal graphite in the iron. The process involves placing a desired quantity of the nodularizing agent in a reaction chamber in a treatment ladle, the latter having a main chamber, a charging and filling passage leading to the reaction chamber, and one or more passages leading from the reaction chamber to the main chamber of the ladle. Molten base metal iron is then poured into the reaction chamber via the charging and filling passage thereby to effect a reaction between the nodularizing agent and the molten base metal. A hydrostatic pressure head of the molten base metal is rapidly established over the reaction chamber of sufficient depth thereby to minimize the vaporization of the nodularizing agent and to maximize the recovery of the nodularizing agent in the base metal. The base metal with the nodularizing agent dissolved and mixed therein is then permitted to flow into the main chamber via the passages. The base metal with the nodularizing agent therein is held in the main chamber for a time sufficient to convert the base metal into a matrix which when solidified is populated with spheroidal graphite.

The apparatus of this invention relates to a ladle in which the above-identified process can be carried out.

10 Claims, 9 Drawing Figures

METHOD OF AND APPARATUS FOR THE PRODUCTION OF NODULAR (DUCTILE) CAST IRON

BACKGROUND OF THE INVENTION

This invention relates to a method or process of and apparatus for the production of nodular (ductile) cast iron. More specifically, it relates to such a process and apparatus in which the reaction between the nodularizing agent and the molten base metal is carried out within a treatment ladle and is thus referred to as an "in-ladle" treatment process.

Ductile cast iron is a casting material consisting essentially of a steel matrix populated with spheroidal graphite. Ductile irons generally exhibit a relatively high yield strength which is superior to both grey and malleable irons as well as to some unalloyed steels. Ductility is generally the capability of the material to bend, warp, or to otherwise plastically deform without failure. In many applications, ductile iron is utilized as a increased safety factor. Ductile cast irons have been known since 1946. Generally, a molten base metal iron may be transformed into ductile iron by inoculating the base metal with a suitable reactive nodularizing agent, such as magnesium, cerium, lanthanum, calcium, potassium, lithium, sodium, beryllium or yttrium. Of these nodularizing agents, magnesium is the most favored in current ductile iron production proccesses. These nodularizing agents promote the formation of graphite spheroids in the base metal matrix, as opposed to the formation of graphite flakes. A high percentage of graphite spheroids generally results in satisfactory ductile iron.

One conventional treatment of base irons for the production of ductile iron for castings is the so-called "pour-over" process. The pour-over process utilizes a treatment ladle in which a magnesium containing alloy substance of the proper quantity is placed. Then, the molten base metal is poured into the treatment ladle so as to effect vaporization of the magnesium. As the magnesium vaporizes, it is released into the molten base metal and becomes distributed in the base metal thereby to form graphite spheroidal nodules. While, in practice, it is theoretically possible to use pure magnesium as the nodularizing agent, due to the violence of the reaction between the molten iron the pure magnesium, most production processes utilize a magnesium containing alloy substance which moderates the reaction by reducing the rate at which the magnesium vapors are released into the base iron. For example, the percentage of magnesium in the nodularizing agent may vary between 3% and 9%.

A variation of the pour-over process is the sandwich method in which the magnesium treating alloy (the nodularizing agent) is placed in a depression located at the bottom of the ladle and is covered with steel punchings or trimmings (sheet-metal plates). Because the nodularizing agent is shielded from the base metal when the base metal is initially poured into the treating ladle, a substantial amount of the base metal will fill the ladle before the reaction between the nodularizing agent and the base metal begins in earnest. Because the nodularizing agent is covered by a sufficient depth of the base metal, higher recoveries of the magnesium can be obtained than by the pour-over process.

Certain ductile iron foundries utilize a so-called plunging ladle in which the base iron is first poured into the treatment ladle. These treatment ladles are then covered and a plunging bell having the nodularizing agent located therewithin is forceably plunged down into the molten metal in the ladle. The plunging bell has holes therein which permit the reaction between the molten base metal and the nodularizing agent to take place. Since the plunging bell is covered by sufficient depth of the base metal and since the ladle is closed, relatively high recovery rates are possible. In variations of the plunging method, the plunging ladle may be sealed closed thereby to result in a semi-pressurized process.

Another process, known as the so-called T-nock process, is an injection process utilizing a nozzle box which is placed over the pouring ladle and the base iron flows through a nozzle of the pouring box as it flows into the ladle. As the base iron is discharged via the nozzle into the ladle, it contacts the magnesium nodularizing agent and causes the magnesium to mix with the base metal. However, this T-nock process is highly dependent on the flow velocity of the base iron passing over the magnesium alloy and is critical to temperatures, times, flow rates, and quantities of ductile iron to be produced.

The so-called "in-stream" treatment process involves the use of a treatment unit having a flow path therethrough into which the molten base metal is poured prior to its being poured into the ladle. An alloy chamber is provided within the flow path of the in-stream treatment unit so that the base metal rapidly covers the magnesium alloy in the alloy chamber thus allowing the magnesium to vaporize. The alloy is totally submerged by the base metal in the in-stream treatment unit for a time sufficient to complete the vaporization and mixture of the alloy with the base metal. The size of the outlet nozzle of the in-stream treatment unit in relation to its inlet nozzle is regulated to be at least 2 to 1, and preferably 3 to 1 (with the inlet being larger), so as to restrict or to choke the flow of the molten metal discharged from the treatment unit. This choked flow is referred to generally as a "pressurized" system. In this "in stream" system the choked flow insures a proper mixture of the magnesium with the base metal.

In U.S. Pat. No. 3,703,922 issued Nov. 28, 1972 to Clifford M. Dunks et al, a so-called in-mold process is disclosed. This in-mold process utilizes a cavity contained within the gating system for the mold of a casting with an alloy reaction chamber being formed in the mold through which the base metal is poured as it flows into the mold cavity. Like the "in stream" process, this "in-mold" process is also a choked flow or pressurized process.

Still other systems are known in which the base metal is treated within the ladle. One of these in-ladle treatment process utilizes a ladle which has a porous, detachable cover placed within the ladle and spaced above the bottom of the ladle thus forming a reaction chamber in which the magnesium alloy is placed. A generally horizontal wall extends out from one side of the ladle above the bottom and thus defines a reaction chamber between the partial wall and the bottom. Upon filling the ladle with molten base iron, the base iron contacts the magnesium and a relatively violent reaction occurs. The cover and the wall are intended to at least in part contain this reaction. Other in-ladle treatment methods utilize an open-top ladle having a syphon passage in communication with the upper part of the ladle and a closed reaction chamber below the bottom of the ladle. The magnesium alloy is placed in the reaction chamber and a cover is placed over the reaction chamber to seal it from the main chamber of the ladle. The main ladle chamber is filled with molten metal and the ladle is tilted so as to fill the syphon tube and the reaction chamber so that the reaction takes place and the magnesium becomes mixed with the base metal.

Reference may be had to such U.S. patents as U.S. Pat. Nos. 3,619,173, 3,802,680, 3,819,365, 3,883,361, 3,870,512, 3,955,974, 4,033,766, 3,034,970 and 4,134,757 in the same general field as the instant invention.

While each of the above-identified processes of making ductile cast iron has its advantages, they also each have their disadvantages or drawbacks. For example, in the pour-over ladle method, a relatively low recovery rate of magnesium is obtained. While the sandwich treatment method does result in a higher recovery of the magnesium, the additional cost of the cover steel results in higher production costs. Even with the cover steel, the magnesium recovery rates of the sandwich treatment method are relatively low. The plunger process, the T-nock process, the in-stream process and the in-mold process all require substantial capital investment to utilize these processes. The in-ladle treatment processes described above, all tend to have relatively low magnesium recovery rates. The syphon treatment method described-above, has the drawback that it requires the ladle filled with molten metal to be tilted so that the molten metal will flow down the syphon tube to the reaction chamber.

There has been a long standing need for a process of producing ductile cast iron which utilizes low cost apparatus, which does not require major changes to the methods typically used by foundries in the casting of articles of ductile cast iron, and yet which has relatively high recovery rates for the magnesium.

SUMMARY OF THE INVENTION

Among the several objects and features of the present invention may be noted the provision of a method of and apparatus for the production of nodular or ductile cast iron in which the apparatus for carrying out the process is relatively inexpensive to procure;

The provision of such a method which may be readily incorporated into existing ductile cast iron casting processes;

The provision of such a method of producing ductile cast iron which requires approximately the same amount of time to treat the iron as does conventional, more complicated processes;

The provision of such an apparatus which has a relatively long service life and which may be readily refurbished for reuse;

The provision of such a method and apparatus for the production of ductile cast iron in which the recovery rates for the nodularizing agent (e.g., a magnesium alloy) is relatively high compared to other in-ladle treatment processes;

The provision of such a process and method which is initially a so-called pressurized system (i.e., it does choke the flow of treated base metal from the reaction chamber) thus permitting the rapid filling of the reaction chamber thereby to rapidly cover the nodularizing agent in the reaction chamber with molten base metal under a hydrostatic head so as to prevent undue oxidation and loss of the nodularizing agent, but yet, after the rapid filling of the reaction chamber, is an unpressurized or unchoked system thereby to permit the rapid filling of the main chamber of the ladle;

The provision of such a process and apparatus which decreases the amount of pollutants (e.g., magnesium oxide) which is discharged to the atmosphere during treatment of the molten base irons; and The provision of such a method and apparatus which is easy to use and requires no special training or skills, which is of rugged construction, which facilitates production, and which has a long service life.

Other objects and features of this invention will be in part apparent and in part pointed out hereinafter.

Briefly stated, the process of this invention relates to the production of ductile cast iron from a molten base iron which, but for the treatment of this process, would be a grey cast iron upon solidification. This process is carried out in a treatment ladle lined with a suitable refractory material, the ladle having a main chamber, a reaction chamber, and a charging and filling passage leading from the top of the ladle to the reaction chamber, the latter being in communication with the lower portion of the main chamber. Specifically, the process includes charging the reaction chamber with a quantity of nodularizing agent via the charging and filling passage. Molten base metal is poured into the reaction chamber via the charging and filling passage thereby to effect a reaction between the nodularizing agent and the base metal. A hydrostatic pressure head of the molten metal is rapidly established over the reaction chamber of sufficient depth thereby to minimize the escape of the nodularizing agent vapors and to maximize the recovery of the nodularizing agent in the base metal. The base metal with the nodularizing agent therein is permitted to flow into the main chamber, and the base metal and the nodularizing agent mixed therewith are held in the main chamber for a time sufficient to convert the base metal into a matrix which when solidified is populated with spheroidal graphite.

Apparatus of this invention relates to the treatment of molten ferrous base metal which, but for the treatment of this invention, would form grey cast iron upon solidification. The apparatus comprises a ladle having a structural shell, and means for supporting the ladle for selectively tilting the ladle for pouring the treated metal therefrom. A refractory liner is formed within the shell of the ladle, this refractory defining a main chamber, a reaction chamber approximate the lower portion of the main chamber, one or more passages providing communication between the main chamber and the reaction chamber, and a charging passage leading downwardly to the reaction chamber. The reaction chamber is sized so as to contain a sufficient quantity of nodularizing agent for treating a desired quantity of base metal, the nodularizing agent being reactive with the molten base metal in the reaction chamber as the latter is poured into the reaction chamber via the charging passage.

BRIEF DESCRIPTION OF THE DRAWINGS

Corresponding reference characters indicate corresponding parts throughout the several views of the drawings.

DESCRIPTION OF A PREFERRED EMBODIMENTS

Figure 1:
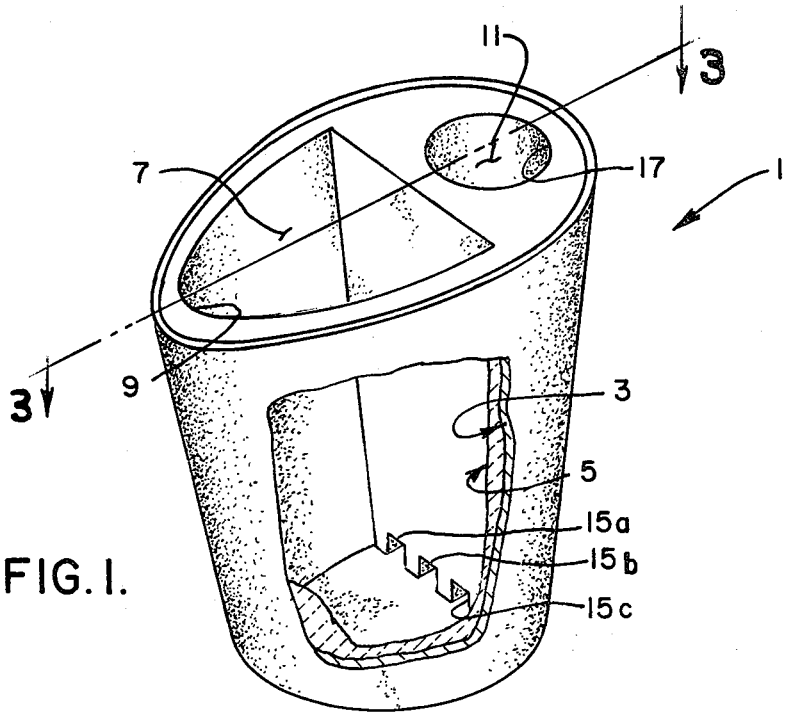
FIG. 1 is a perspective view of a ladle of the present invention for carrying out an in-ladle treatment process for the composition of ductile cast iron in accordance with the method of this invention, part of the sidewall of the ladle being broken away for purposes of illustration and the trunnions and gear box for the ladle being ommited for purposes of clarity.
Figure 3:
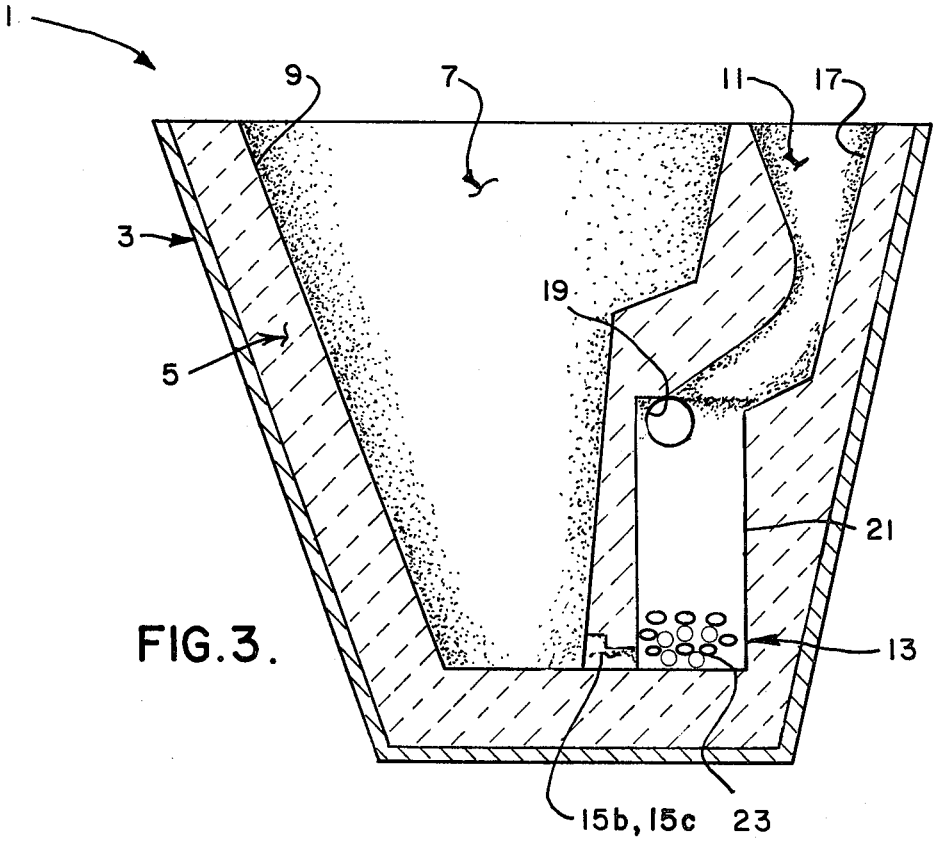
FIG. 3 (sheet 1) a vertical cross sectional view taken along line 3—3 of FIG. 2 illustrating a charging and filling passage leading to a reaction chamber, the latter having choked flow outlets leading from its bottom into a main chamber and, at its top, having passages in communication with other flow outlets of increased cross sectional area thereby to permit substantially unrestricted flow of molten metal from the reaction chamber into the main chamber once the reaction chamber has been initially filled with molten metal.
Figure 2:
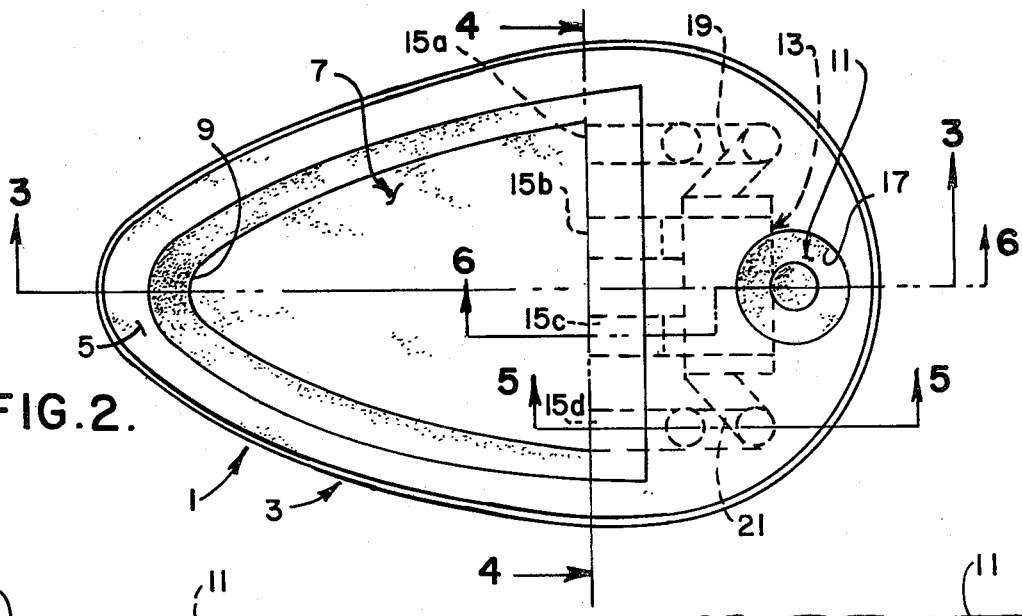
FIG. 2 (sheet 2) is a top plan view of the ladle shown in FIG. 1 with various chambers, passages, and outlets formed in accordance with the apparatus of this invention for carrying out the method of this invention.
Figure 5:
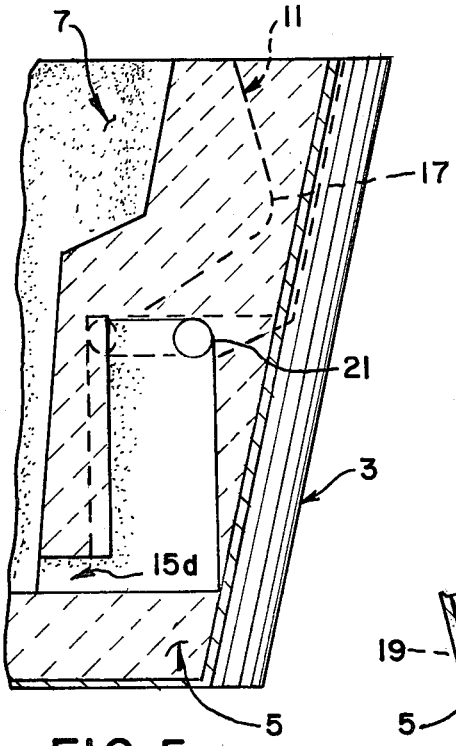
FIG. 5 is a vertical cross sectional view taken along line 5—5 of FIG. 2 illustrating the passages leading from the top of the reaction chamber to an unchoked discharge flow passage.
Figure 6:
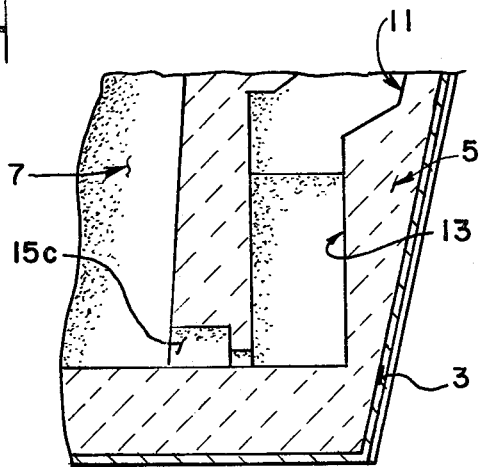
FIG. 6 is a vertical cross sectional view taken along line 6—6 of FIG. 2 illustrating one of the choked flow passages providing communication between the bottom of the reaction chamber and the bottom of the main chamber.
Figure 4:
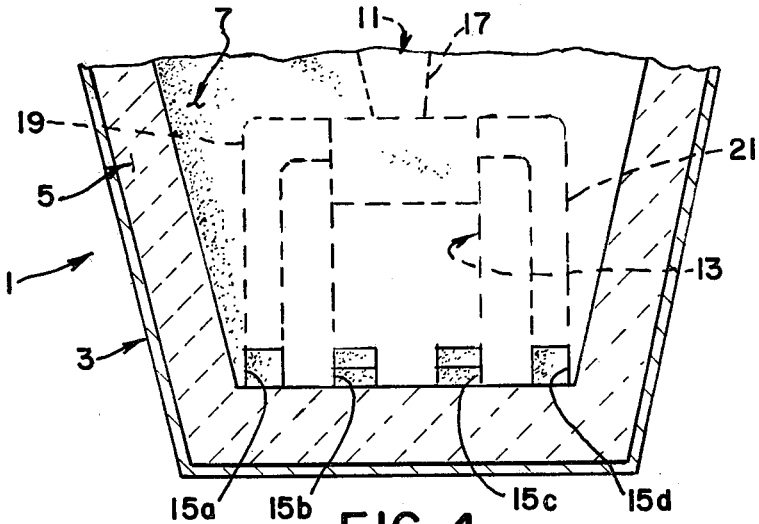
FIG. 4 is a view taken along line 4—4 of FIG. 2 illustrating the choked and unchoked flow passages between the reaction chamber and the main chamber at their discharge into the main chamber.
Figure 7:
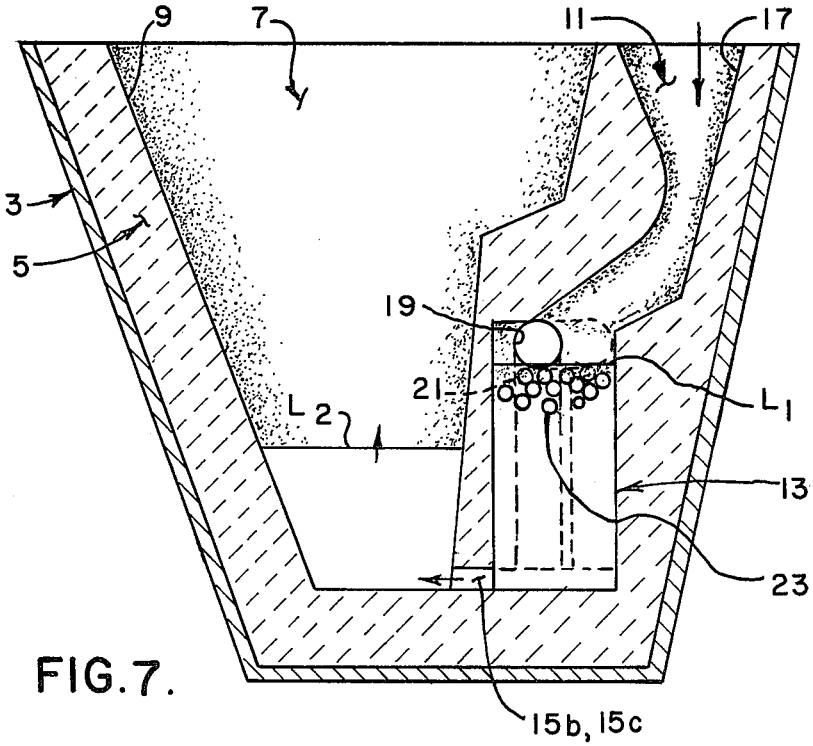
FIG. 7 is a view similar to FIG. 3 in which molten base iron is being poured into the charging and filling passage, illustrating the reaction chamber filled with molten iron which is flowing into the main chamber via the choked flow passages and which has completely filled the reaction chamber and is also flowing into the main chamber via the unchoked side flow passages.
Figure 8:
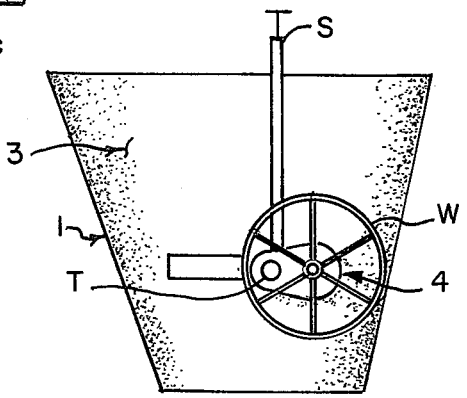
FIG. 8 is a side elevational view of the ladle on a reduced scale illustrating the trunnion and gear box for selectively tilting the ladle from its horizontal holding position (as shown in FIG. 1) to a tilted pouring position (not shown)

Referring now to the drawings and particularly to FIGS. 1–8, a treatment ladle of the present invention as indicated in its entirety by reference character 1. The ladle includes a structural shell, as generally indicated at 3, made of welded steel construction or the like. As shown in FIG. 8, the shell is provided with support trunnions T at opposite sides of the ladle shell and a support S extends above the ladle for supporting the ladle from a crane or the like. As is typical, a gear box 4 is incorporated in the trunnions so that upon operation of the gear box by means of the handwheel W, the ladle 1 may be tilted from its horizontal holding position (as shown in FIG. 8) to a tilted pouring position (not shown) so as to enable one to pour the molten metal from the main chamber of the ladle.

Further, ladle 1 is defined to have a cast-in-place refractory liner, as generally indicated at 5, on the inside of shell 3 so as to form various compartments or chambers and passages in accordance with the apparatus and method of the present invention and for enabling the shell 3 to receive and to hold molten base iron. Preferably, refractory 5 is cast-in-place within shell 3 of a suitable self-hardening refractory material, such as a material sold under the trade designation Purocrete commercially available from Kaiser Refractories. It will be understood, however, that any suitable refractory material generally known to those skilled in the cast iron refinery art would be suitable to cast refractory 5 within shell 3.

In accordance with this invention, a main chamber 7 is cast-in-place within refractory 5 and constitutes a chamber of sufficient volume to hold a desired quantity of molten base metal to be treated. The upper, outer end of main chamber 7 constitutes a pouring nozzle, as indicated at 9. A so-called charging and filling passage or sprue, as generally indicated at 11, is cast-in-place within refractory 5 at the end of the ladle opposite pouring spout 9. The charging and filling passage leads downwardly within refractory 5 to a reaction chamber, as indicated at 13, which is molded-in-place within the refractory and which is in communication with the charging and filling passage. Outlet ports 15*a*–15*d* are provided in refractory 5 to provide communication between reaction chamber 13 and the lower portion of main chamber 7 for purposes as will appear. The upper end of charging and filling passage 11 is of generally converging shape and thus forms an inlet funnel 17. Below the level of funnel 17, the charging and filling passage leads directly to reaction chamber 13.

As best shown in FIG. 6, the choked flow passages 15*b*, 15*c* communicate directly from the bottom of reaction chamber 13 to the bottom of main chamber 7. However, the unchoked side flow passages 15*a*, 15*d* are interconnected to the top of reaction chamber 13 at a level above passages 15*a*, 15*d* by respective cross over passages 19 and 21 such that the side passages will not receive molten metal until reaction chamber 13 has been filled with molten metal.

Referring now to the method of producing ductile cast iron of this invention, a nodularizing agent, as generally indicated at 23, is placed in reaction chamber 13, such as by pouring a granulated or chunk-like nodularizing agent into the filling and charging passage 11. The nodularizing agent falls down through charging and filling passage 11 into reaction chamber 13. The quantity of the nodularizing agent to be placed in the reaction chamber varies depending on the particular type of nodularizing agent and the quantity of base metal to be treated to form ductile cast iron. In accordance with this invention, nodularizing agent 23 may be a ferrosilicon substance having a reactive substance ranging between 1 and 10% by weight of said nodularizing agent, the reactive substance being selected from a group including magnesium, cerium, lanthanum, calcium, potassium, lithium, sodium, beryllium or yttrium;

With the nodularizing agent 23 in place within reaction chamber 13, treatment ladle 1 is then positioned to receive a predetermined quantity of molten base metal from another ladle, a coreless induction furnace, or the like which is poured into funnel inlet 17 of filling and charging passage 11. The pouring rate of the base metal into the filling and charging passage is carried out at an appropriately fast rate (i.e., in excess of the discharge rate of molten base metal from the center choked discharge passages 15*b*, 15*c*) so that the base metal fills the reaction chamber. Because the pouring rate of the base metal into passage level is in excess of the discharge rate from choked passages 15*b*, 15*c*, the reaction chamber 13 will rapidly fill with molten base metal thus, at least initially, covering the nodularizing agent 23 with a hydrostatic head of molten metal of sufficient depth so as to prevent any substantial escape of vaporized nodularizing agent. Of course, the continued in flow of molten base metal via passage 11 prevents the nodularizing agent from venting to the atmosphere via passage 11. Because of the choked flow from passages 15*b*, 15*c*, and because of the continued rapid filling of the reaction chamber via charging passage 11, the process is initially a pressurized system effectively preventing any substantial loss of vaporized nodularizing agent to the atmosphere.

As the reaction chamber 13 becomes filled, the nodularizing agent will, at least in certain instances, float to the top of the reaction chamber. However, the inflow of additional molten metal via passage 11 prevents substantial losses of the vaporized nodularizing agent. Also, as the base metal fills the reaction chamber, the molten metal flows via cross over passages 19 and 21 to their respective unchoked side discharge ports 15*a*, 15*d*. Because the total cross sectional area of discharge ports 15*a*–15*d* is greater than or equal to the cross sectional (or flow area) area of funnel 17, the flow from the reaction chamber is now unchoked or unpressurized. Thus, in accordance with this invention, the apparatus and method herein disclosed initially functions as a pressurized system while only the choked discharge passages 15*b*, 15*c* are discharging molten metal such that the level L1 of the molten metal in the reaction chamber may be appreciably above the level L2 of the molten metal in the main chamber 7 (see FIG. 7.). However, after the reaction chamber is filled and all four discharge passages are operable, the system is unpressurized. Once level L1 in the reaction chamber rises above the level of crossover passages 19 and 21, the system will operate in its unpressurized mode because the flow rate from all of the discharge passages 15*a*–15*d* is greater than or equal to the maximum in flow rate of molten metal from inlet 11.

Of course, upon the nodularizing agent 23 coming into contact with the molten base metal, a reaction between the nodularizing agent and the molten base metal will result. For example, if the nodularizing agent is a magnesium alloy, the magnesium will rapidly vaporize immediately upon coming into contact with the molten base metal. However, because the initial flow of the base metal out of the reaction chamber into the main chamber via passages 15*b*, 15*c* is choked, a hydrostatic head of the molten base metal in reaction chamber 13 will substantially instantaneously be imposed upon the nodularizing agent thereby to minimize the amount of vapor (e.g., magnesium oxide) which is permitted to escape from the reaction chamber. In accordance with the method of this invention, this rapid covering of the nodularizing agent within reaction chamber 13 by a substantial hydrostatic head of the molten base metal insures that a large percentage of the nodularizing agent (e.g., magnesium) is mixed with and is absorbed by the molten base metal. This also insures that the amount of the nodularizing agent discharged to the atmosphere is of minimum amount.

As shown in FIG. 7, as the base metal fills reaction chamber 13, the nodularizing agent floats upwardly within the reaction chamber and is thus above and is substantially prevented from being washed out of the reaction chamber due to the flow of the base metal from the reaction chamber into the main ladle chamber via discharge passages 15*b*, 15*c*.

Molten metal will continue to flow downwardly through the filling and charging passage 11 into reaction chamber 13 as the molten metal flows out of the reaction chamber into the main chamber via passages 15*a*–15*d*. Thus, the liquid level L2 of the molten metal within the main chamber will rise in relation to the reaction chamber. It can be seen that, due to the converging bottom of main chamber 7 in ladle 1, the level of the molten metal within the main chamber will initially rise rapidly and then, as the cross-sectional area of the main chamber increases, will rise proportionately slower. Thus, a hydrostatic pressure of the molten metal in main chamber 7 is rapidly established so that it is sufficient to contain the reaction between the nodularizing agent 23 in reaction chamber 13 and the molten base metal under a sufficient hydrostatic head so as to prevent any substantial loss of the nodularizing agent prior to the nodularizing agent becoming thoroughly mixed with the base metal.

Once all of the predetermined charge of base metal is poured into charging and filling passage 11, the base metal becomes sufficiently and thoroughly mixed with the nodularizing agent due to convection currents existing within the molten base metal as it stands in the ladle and due to the hydrodynamic circulation of the molten base metal as it flows from the reaction chamber into the main chamber. Because this mixing takes place in a relatively short time (i.e., essentially during the time required to fill the main chamber), the temperature of the base metal may be easily maintained at a desirable pouring temperature. After the base metal and the nodularizing agent have been thoroughly mixed, ladle 1 may be transported to a desired location and wheel W is turned so as to tilt ladle 1 via gear box 4 thereby to pour the inoculated or nodularized base metal into a pouring ladle or the like for casting the base metal into a desired casting.

A series of tests was conducted utilizing a ladle generally as shown in FIGS. 1–5 and utilizing the above-described method of the present invention for the treatment of molten base iron to form ductile iron. The nodularizing agent used was a magnesium alloy nodularizing agent sold by Miller & Company of Chicago, Ill. under the trade designations Noduloy 9R, 5R-1, and 3R, respectively indicating magnesium percentage in the nodularizing agent of 9%, 5% and 3%. Each nodularizing agent alloy was evaluated using three treatment sizes of base iron of 500 lbs., 1,000 lbs., and 2,000 lbs. In Table 1, the test data of these series of tests are presented. This test data includes the tap time (i.e., the time, expressed in seconds, to pour the predetermined quantity of molten base iron into the charging and filling passage 11 thereby to fill the main chamber with the molten base iron) and pertinent chemistry of the various elements constituting the ductile cast iron. In addition, the ultimate tension strength (UTS) and the yield strength (YS) expressed in pounds per square inch is also presented as well as the elongation of the sample. The hardness of the sample as expressed in Brinell hardness numbers (BHN). The last column (NOD) indicates the percentage of nodularity of the graphite nodules in the sample, expressed as a percentage. The samples from which the data on table 1 were obtained were taken after a 10 minute holding period of the inoculated base metal in main chamber 7 of the ladle 1.

Figure 9:
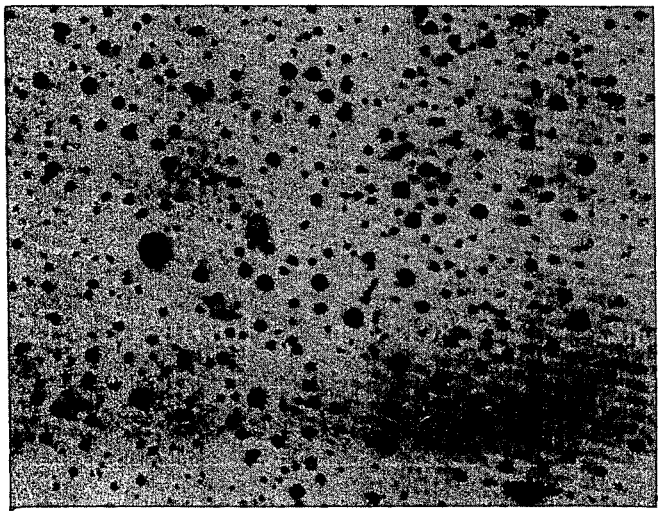
FIG. 9 is a photomicrograph of a typical specimen of ductile cast iron made in apparatus of this invention and made in accordance with the process of this invention.

FIG. 9 is a photomicrograph of a sample take after 10 minutes from initiating the tap to fill the ladle utilizing a 3% nodularizing agent corresponding generally to ladle XXI in Table 1.

TABLE 1

| Ladle No. | TRMT lbs | Alloy % | Alloy lbs | Tap Time | C % | Si % | S % | Mg % | Mn % | Cr % | Cu % | UTS (psi) | YS (psi) | Elong % | BHN | Test Dia. | NOD % |
|---|---|---|---|---|---|---|---|---|---|---|---|---|---|---|---|---|---|
| | | | | | Test Data | | | | | | | | | | | | |
| XX1 | 1000 | 3 | 15 | 33 | 3.82 | 2.96 | .012 | .030 | .39 | .03 | .19 | 69,009 | 49,141 | 20 | 170 | .502 | 97 |
| XX2 | 1000 | 5 | 12 | 38 | 3.84 | 2.97 | .013 | .018 | .43 | .04 | .20 | 57,742 | 42,569 | 11 | 156 | .496 | 75 |
| XX3 | 1000 | 9 | 9 | 27 | 3.84 | 2.65 | .014 | .031 | .41 | .03 | .19 | 61,051 | 42,658 | 19 | 159 | .497 | 96 |
| XX4 | 500 | 3 | 8 | 16 | 3.82 | 2.86 | .014 | .028 | .41 | .03 | .19 | 66,572 | 47,252 | 13 | 163 | .474 | 95 |
| XX5 | 500 | 5 | 6.5 | 17 | N/A | 2.73 | N/A | .024 | .40 | .03 | .19 | 63,704 | 44,647 | 15 | 159 | .488 | 82 |
| XX6 | 500 | 9 | 5 | 17 | 3.88 | 2.46 | .016 | .023 | .41 | .03 | .20 | 64,194 | 44,835 | 14 | 159 | .504 | 83 |
| XX7 | 2000 | 3 | 28 | 45 | 3.85 | 2.60 | .015 | .026 | .40 | .03 | .18 | 61,368 | 45,573 | 15 | 163 | .503 | 87 |
| XX8 | 2000 | 5 | 24 | 51 | 3.88 | 2.55 | .014 | .025 | .39 | .03 | .19 | 64,459 | 43,680 | 11 | 163 | .502 | 83 |
| XX9 | 2000 | 9 | 18 | 46 | 3.89 | 2.40 | .016 | .021 | .40 | .03 | .20 | 57,820 | 40,652 | 7 | 156 | .500 | 69 |
| XX10 | 1000 | 5 | 24 | 22 | 3.91 | 2.62 | .016 | .026 | .39 | .03 | .19 | 63,129 | 44,970 | 14 | 156 | .503 | 87 |

It was observed that the magnesium alloy percentages of the nodularizing agent proved overly reactive when it came in contact with the molten base metal and this accounted for the low percentages of nodularity experienced in ladle XX9 of Table 1.

Based on initial test results, the process and apparatus of the instant invention has been found to reduce the amount of magnesium alloy required for treatment of ductile cast iron by about 30–50%, as compared with conventional sandwich treatment processes. For example, if a 5% magnesium nodularizing agent is used in the conventional sandwich process, a magnesium recovery factor of about 30–35% could be expected. However, if a 5% magnesium nodularizing agent were used in the process of the instant invention, a 45–55% magnesium recovery factor has been found. This results in up to 33% savings in the amount of nodularizing agent that must be used by employing the process of the present invention. If a 3% magnesium alloy is used in the conventional sandwich process, one could expect a magnesium recovery factor ranging between 40–45%. If the 3% magnesium nodularizing agent were used in the method or process of the instant invention, a 60–70% recovery factor could be expected. Here, using the 3% alloy, the process of the instant invention would allow one to realize about a 35% savings in the amount of the nodularizing agent required to treat a ladle while realizing a high percentage of nodularity. As compared to the sandwich process, the utilization of the process and apparatus of the instant invention eliminates the need for the cover steel used in the sandwich process and thus appreciable cost savings can be realized due both to the reduced amounts of the nodularizing agent required and also because of the elimination of the cover steel.

As those skilled in the art will recognize, once the base iron has been treated with the nodularizing agent in the ladle 1, the treated iron may be subjected to a post inoculation treatment for promoting crystallization or the formation of graphite spheroids, the suppression of carbide formation, and to increase the eutectic cell count. Generally, a ferro-silicon inoculant is the most widely used. However, these post inoculation procedures are well-known in the prior art and do not, per se, constitute a part of this invention and hence will not be described in detail.

It is to be understood that the method and apparatus of this invention, substantially as described, may also be utilized in the production of compacted graphite iron, as well as ductile iron. The terms "ductile iron" or "nodular iron" are used in a broad sense to include any iron alloy treated with an agent to promote the formation of spheroidal graphite or to inhibit the formation of flake graphite.

In view of the above, it will be seen that the several objects and features of this invention are achieved and other advantageous results obtained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. A process for the production of ductile cast iron from a molten base iron which, but for the treatment of said process, would be a grey cast iron upon solidification, said process being carried out in a treatment ladle lined with a suitable refractory material, said ladle having a main chamber therein, a reaction chamber, and a charging and filling passage leading from the top of said ladle to said reaction chamber, the latter being in communication with the lower portion of the main chamber, said process comprising of the steps of:

charging said reaction chamber with a quantity of a nodularizing agent;

pouring said molten base metal into said reaction chamber via said charging and filling passage thereby to effect a reaction between said nodularizing agent and said base metals;

rapidly establishing a hydrostatic pressure head over said reaction chamber of sufficient depth thereby to maximize the recovery of said nodularizing agent in said base metal; and permitting said base metal with the dissolved nodularizing agent therein to flow into said main chamber.

2. A process as set forth in claim 1 further comprising of tilting said ladle so as to pour said treated molten metal from said main chamber, from said reaction chamber, and from said charging and filling passage.

3. A process as set forth in claim 1 wherein said molten base metal flows out of said reaction chamber into said main chamber at a level below which the reaction between the nodularizing agent the base metal takes place within said reaction chamber.

4. A process as set forth in claim 1 wherein said base metal flows down into said reaction chamber in generally horizontally out of said reaction chamber into said main chamber.

5. An in-ladle process of treating a molten cast iron base metal with a magnesium based nodularizing agent, the ladle having a main chamber, a reaction chamber adjacent the bottom of said main chamber, a charging and filling passage leading downwardly from the top of the ladle to said reaction chamber, and one or more passages leading from said reaction chamber into said main chamber, said process comprising of the steps of:

placing a predetermined quantity of nodularizing agent in said reaction chamber;

rapidly filling said main chamber with a desired quantity of molten iron via said charging and filling passage, via said reaction chamber, and via said reaction chamber/main chamber passages;

establishing a level of said molten base metal above said nodularizing agent within said reaction chamber of sufficient depth to substantially contain the reaction between said magnesium nodularizing agent and said molten base metal so as to inhibit the escape of excess magnesium oxide to the atmosphere and so as to maximize the recovery of magnesium within the molten base metal; and holding said molten base metal in said main chamber for a time sufficient to complete the mixing of said magnesium and said base metal.

6. The process of claim 5 further comprising of the step of inoculating the treated base metal by introducing a suitable inoculate to promote the formation of spheroidal graphite in the treated base metal.

7. An in-ladle process of treating molten iron base metal which, but for the treatment of said process, would be grey iron upon solidification, said process being carried out in a ladle havin a main chamber, a reaction chamber separate from and interconnected to the bottom portion of said main chamber, and a charging passage separate from said main chamber in communication from above with said reaction chamber, said process comprising of the steps of:

a placing a charge a nodularizing agent in said reaction chamber, said nodularizing agent containing a reactive substance ranging between 1 and 10% by weight of said nodularizing agent, said reactive substance being selected from magnesium, cerium, lanthanum, calcium, potassium, lithium, sodium, beryllium or yttrium;

pouring said molten base iron into said main chamber via said charging passage and said reaction chamber wherein said molten metal reacts with said reactive substance as said molten metal flows through said reaction chamber into said main chamber; and inducing a reaction between said molten base metal and said reactive agent as said base metal flows through said reaction chamber into said main chamber wherein between 65% and 99% of said reaction agent in the nodularizing agent placed in said reaction chamber is recovered by said molten metal poured from said main chamber.

8. An in-ladle process of treating a molten cast iron base metal with a magnesium based nodularizing agent, the ladle having a main chamber, a reaction chamber adjacent the bottom of said main chamber, a charging and filling passage leading downwardly from the top of the ladle to said reaction chamber, one or more discharge passages leading from the bottom of said reaction chamber into said main chamber, and one or more other discharge passages leading from said reaction chamber at a level above said bottom discharge passages to said main chamber, said process comprising of the steps of:

placing a predetermined quantity of nodularizing agent in said reaction chamber;

introducing molten iron into said reaction chamber via said charging and filling passage at a rate greater than said molten metal may be discharged from said reaction chamber into said main chamber via said discharge passages at the bottom of the reaction chamber;

establishing a level of said molten iron within said reaction chamber of sufficient depth to substantially contain the reaction between said nodularizing agent and said molten iron so as to dissolve said nodularizing agent into said iron, so as to inhibit the escape of said nodularizing agent to the atmosphere, and so as to maximize the recovery of said nodularizing agent within the molten iron;

after filling of said reaction chamber with molten iron to the level of said other discharge openings, discharging molten iron into said main chamber from all of said discharge openings at a rate greater than or equal to the rate at which said molten iron may be introduced into said reaction chamber via said charging and filling passage; and holding said molten iron in said main chamber for a time sufficient to complete the mixing of said magnesium and said base metal.

9. Apparatus for the treatment of a molten ferrous based metal which, but for treatment, would form grey cast iron upon solidification, said apparatus comprising a ladle having a structural shell, means for supporting said ladle and for selectively tilting the ladle for pouring the treated metal therefrom, a refractory liner within said shell, said refractory liner defining a main chamber, a reaction chamber proximate to the lower portion of said main chamber, one or more discharge passages providing communication between the reaction chamber and said main chamber, and a charging passage leading downwardly to said reaction chamber, said reaction chamber being sized so as to contain a sufficient quantity of said nodularizing agent, the latter being reactive with said molten base metal as the latter is poured into said charging and filling passage.

10. Apparatus as set forth in claim 9 having at least two of said discharge passages between said reaction chamber and said main chamber, at least one of said discharge passages being in communication with the bottom of said reaction chamber and with said main chamber, this last-said at least one discharge passage having a choked flow area such that the discharge rate of molten metal from said reaction chamber into said main chamber via said at least one discharge passage is less than the filling rate of said reaction chamber via said charging passage, and at least one other of said discharge passages being in communication with the upper portion of said reaction chamber and being operable to discharge molten iron into said main chamber only after said reaction chamber has been at least substantially filled with molten metal, the combined flow areas of all of said discharge passages being greater than or equal to the minimum cross sectional area of said charging passage so that the flow of molten metal from said reaction chamber into said main chamber via all of said discharge passages is equal to or greater than the flow of molten metal into said reaction chamber via charging passage.

* * * * *